US006443829B1

(12) United States Patent
Perkitny

(10) Patent No.: US 6,443,829 B1
(45) **Date of Patent: *Sep. 3, 2002**

(54) COIN SORTING APPARATUS

(76) Inventor: Jerzy Perkitny, 28115 Osborn Rd., Bay Village, OH (US) 44140

( * ) Notice: Subject to any disclaimer, the term of this patent is extended or adjusted under 35 U.S.C. 154(b) by 0 days.

This patent is subject to a terminal disclaimer.

(21) Appl. No.: 09/616,650

(22) Filed: Jul. 14, 2000

Related U.S. Application Data

(63) Continuation of application No. 09/013,631, filed on Jan. 26, 1998, now Pat. No. 6,099,401, which is a continuation-in-part of application No. 29/066,609, filed on Feb. 12, 1997, now Pat. No. Des. 393,530.

(51) Int. Cl.[7] ..... G07D 3/00
(52) U.S. Cl. ..... 453/9
(58) Field of Search ..... 453/9, 10, 12, 453/14, 15

(56) References Cited

U.S. PATENT DOCUMENTS

| | | | | |
|---|---|---|---|---|
| 1,433,943 A | | 10/1922 | Doldt | |
| 1,819,235 A | | 8/1931 | Donnellan | |
| 1,823,829 A | * | 9/1931 | Jones et al. | |
| 3,161,351 A | | 12/1964 | Lerner | 232/5 |
| 3,242,931 A | | 3/1966 | Wandrey | 133/6 |
| 3,313,477 A | | 4/1967 | Brown | 232/5 |
| 3,338,250 A | | 8/1967 | Mehelich | 133/3 |
| 3,410,385 A | | 11/1968 | Freet et al. | 194/39 |
| 3,844,297 A | | 10/1974 | Lautzenhiser | 133/1 A |
| 3,882,659 A | | 5/1975 | Charlop | 53/254 |

(List continued on next page.)

FOREIGN PATENT DOCUMENTS

GB 2 130 779 A 6/1984 ..... G07D/9/00

*Primary Examiner*—Donald P. Walsh
*Assistant Examiner*—Mark J Beauchaine
(74) *Attorney, Agent, or Firm*—Fay, Sharpe, Fagan, Minnich & McKee, LLP

(57) ABSTRACT

A coin sorting apparatus (A) includes a hopper (10) into which a plurality of unsorted coins are deposited. A push-button switch (30) is positioned adjacent the open mouth of the hopper (10) and is operable in a one-handed manner by an operator of the apparatus (A) simultaneously with the action of depositing unsorted coins into the hopper. A coin separating mechanism dispenses coins from the hopper onto a ramp (20) upon which the coins roll downward and pass through one of a plurality of apertures (22) formed through the ramp according to their diameter. Coins that pass through each aperture (22) are deposited onto one of a plurality of coin chutes **(40*a*–40*d*) . A plurality of sorted coin wrappers (W) are positioned respectively adjacent lower edges of the chutes (40*a*–40*d*) , respectively. The wrappers are supported at their open upper ends (70) by a collar assembly (50) and at their constricted lower ends (72) by a base assembly (60). Coins from each chute (40*a*–40*d*) are deposited directly into the appropriate one of the plurality of coin wrappers, without the need for any intermediate or additional sorted coin containers. A baffle (44) is positioned over the chutes (40*a*–40*d*) and forces the coins on each chute to slide on either their front or rear faces rather than roll or bounce. In the event a wrapper is filled to capacity with coins, an overflow tray (80) extends from a forward region of the apparatus (A) and coins that pass over a filled wrapper drop into the tray (80). An overflow coin deflector (82) is provided to ensure that these overflow coins do not overshoot the tray (80) altogether or enter the tray at such an angle and with such velocity that they bounce from the tray (80)**.

36 Claims, 7 Drawing Sheets

U.S. PATENT DOCUMENTS

| | | | | | |
|---|---|---|---|---|---|
| 4,396,029 | A | | 8/1983 | Anderson | 133/3 |
| D270,868 | S | | 10/1983 | Spirk, Jr. et al. | D99/35 |
| 4,407,314 | A | * | 10/1983 | Ventura | 133/8 |
| 4,479,502 | A | | 10/1984 | Iversen | 133/1 A |
| 4,495,959 | A | * | 1/1985 | Farber | 133/1 |
| 4,511,341 | A | | 4/1985 | Spirk, Jr. et al. | 446/9 |
| D283,075 | S | | 3/1986 | Spirk, Jr. et al. | D99/34 |
| 4,593,709 | A | * | 6/1986 | Duplessy | 133/3 |
| D288,499 | S | | 2/1987 | Wan | D99/36 |
| 4,694,845 | A | * | 9/1987 | Zay | 453/59 |
| D296,029 | S | | 5/1988 | Knox | D99/35 |
| 4,987,990 | A | | 1/1991 | Perkitny | 194/242 |
| 4,995,848 | A | | 2/1991 | Goh | 453/3 |
| 5,122,093 | A | | 6/1992 | Perkitny | 453/13 |
| D347,929 | S | | 6/1994 | Perkitny | D99/34 |
| 5,474,496 | A | | 12/1995 | Perkitny | 453/9 |
| 5,827,117 | A | * | 10/1998 | Naas | 453/9 |

* cited by examiner

COIN SORTING APPARATUS

This application is a continuation of U.S. application Ser. No. 09/013,631, filed on Jan. 26, 1998, now U.S. Pat. No. 6,099,401, which is a continuation-in-part of U.S. design patent application Ser. No. 29/066,509 filed Feb. 12, 1997 now U.S. Design Pat. No. 393,530.

BACKGROUND OF THE INVENTION

The invention relates to a coin sorting apparatus. More particularly, it relates to a compact and easy-to-use coin sorting apparatus which sorts coins of various denominations and deposits the coins directly into the appropriate conventional coin wrapper, without the need for sorted coin tubes or other sorted coin containers. The subject coin sorting apparatus also allows for one-handed and simultaneous coin loading and operation. Once the sorted coins are deposited into the appropriate wrappers, the wrappers are easily removed from the apparatus and closed at their open ends for retaining the sorted coins. Finally, the coin sorting apparatus conveniently retains coins that overflow the various coin wrappers for subsequent sorting operations.

Coin sorting devices are generally known. A user places a plurality of coins in a hopper or similar coin receiving location. A coin separating mechanism separates the coins and dispenses them one at a time from the hopper onto an inclined ramp structure where they fall, under the force of gravity, into a coin sorting mechanism or ramp region. Most commonly, the coin sorting mechanism classifies the coins by their diameter. Coins of a particular diameter, and consequently of a particular denomination, are directed into the appropriate one of a plurality of sorted coin storage containers.

One deficiency with known coin sorting devices is that they require the use of rigid plastic tubes or other sorted coin containers to retain the sorted coins. With prior sorting devices of this type, the sorted coins in these tubes or other containers must be manually transferred into conventional paper or plastic coin storage wrappers as are well known. Other prior devices allow the paper coin wrappers to be placed directly in the coin storage tube or other container during coin sorting operations so that coins are deposited into the coin wrappers. However, these prior devices still require the use of the coin storage tube. If the sorted coin storage tube is lost or damaged, further coin sorting is not possible. Furthermore, with these prior devices, removal of the sorted coin container from the sorting device, and removal of the filled coin wrapper from its associated container can lead to coin spillage and other difficulties.

Another drawback associated with prior coin sorting devices is the lack of an effective switch mechanism which allows the electro-mechanical coin separator mechanism to be activated by an operator simultaneously with the same hand motion used to load unsorted coins into a coin hopper of the apparatus. Certain prior sorting devices include a simple on/off toggle switch which must be activated separately with respect to the action of depositing unsorted coins into the coin hopper. Other coin sorting devices rely upon a lever or other switch located in the hopper to automatically activate the coin separating device when coins are deposited in the hopper based upon the weight or presence of the coins. The former type of switch is generally inconvenient. The latter has been found to be effective and easy to use, but adds complexity and expense to the apparatus, both in terms of the components and their assembly.

In coin sorting operations, it is common that the sorted coins of a particular denomination exceed the capacity of the sorted coin storage tubes or other containers. When this happens, the sorted coins spill over onto the table top or other support surface upon which the sorting device is positioned. In such case, the coins often bounce or roll away and are generally difficult to locate and retrieve. Other coin sorting devices include some tray or other means for collecting overflow sorted coins. However, with these prior sorting devices, it has been found that coins oftentimes overshoot the tray altogether or drop into the tray with excessive velocity and at such an angle that they bounce from the tray. Of course, any attempt to make the tray more restrictive to improve its coin retention properties, e.g., with a removable cover or the like, also renders it more inconvenient for a user to extract the overflow coins therefrom.

With coin sorting apparatus, it is always desirable to improve the consistency and accuracy with which coins are handled. Only in this manner may proper coin sorting may be achieved. In particular, it is especially important to prevent undesirable rolling and bouncing of coins, especially just upstream relative to the sorted coin containers. Also, it is desirable that the sorted coins be communicated toward the sorted coin containers along a single axis.

Accordingly, it has been deemed desirable to develop a new and improved coin sorting apparatus which overcomes the foregoing deficiencies and others while providing better and more advantageous overall results.

SUMMARY OF THE INVENTION

According to the present invention, a new and improved coin sorting apparatus is provided.

In accordance with a first aspect of the invention, the coin sorting apparatus includes a hopper for receiving a plurality of unsorted coins and a coin separating mechanism for dispensing coins from the hopper onto a ramp. The ramp includes a plurality of spaced, differently sized apertures formed therethrough such that each coin on the ramp is deposited onto one of a plurality of spaced coin chutes according to its diameter. A coin wrapper collar assembly releasably secures an open upper end of each of a plurality of coin wrappers adjacent a respective one of the plural coin chutes, while a coin wrapper base assembly supports a lower end of each of the coin wrappers. The coin wrapper collar assembly and the coin wrapper base assembly together operatively support the plurality of coin wrappers which each receive sorted coins directly from a respective one of the plurality of coin chutes.

In accordance with another aspect of the invention, the coin sorting apparatus includes a hopper for receiving a plurality of unsorted coins. The hopper includes a funnel portion with an enlarged mouth. An electro-mechanical coin separating mechanism dispenses coins from the hopper onto a ramp which includes a plurality of differently sized apertures formed therethrough such that coins from the ramp are deposited onto one of a plurality of coin chutes according to their diameter. The sorting apparatus also includes means for supporting a plurality of sorted coin wrappers respectively adjacent a lower edge of each of said plurality of coin chutes whereby coins of a particular diameter and denomination are conveyed by each chute from the ramp into an open upper end of the wrapper adjacent the lower edge of the chute. A normally open push-button switch is positioned adjacent the enlarged mouth of the funnel portion of the hopper. The switch is operable and closable with an operator's hand simultaneously with the operation of loading coins into the hopper from the operator's hand to selectively energize the electro-mechanical coin separating mechanism.

In accordance with still another aspect of the present invention, a coin sorting apparatus includes a hopper for receiving a plurality of unsorted coins, and a coin separating mechanism for dispensing coins from the hopper onto a ramp. The ramp includes a plurality of differently sized apertures formed therethrough such that coins on the ramp pass through one of the apertures and are deposited onto one of a plurality of coin chutes according to their diameter. The coin sorting apparatus also includes means for supporting a plurality of sorted coin wrappers adjacent a lower edge of each of the plurality of coin chutes so that coins from each chute are deposited into an open upper end of a respective one of the plurality of wrappers. A coin overflow tray extends forwardly beneath the plurality of sorted coin wrappers and receives overflow coins from the plurality of chutes when a wrapper adjacent one of said chutes is filled to capacity with sorted coins. An overflow coin deflector is forwardly spaced from the plurality of chutes and deflects overflow coins from each of the chutes downward into the coin overflow tray.

One advantage of the present invention is found in the provision of a new and improved coin sorting apparatus.

Another advantage of the present invention is the provision of a coin sorting apparatus that deposits sorted coins directly into conventional sorted coin wrappers, without requiring the intermediate or simultaneous use of coin tubes or other containers.

Still another advantage of the present invention is the provision of a coin sorting apparatus in which filled coin wrappers are conveniently and easily removed from the sorting apparatus without spillage of sorted coins.

Yet another advantage of the present invention is the provision of a coin sorting apparatus which effectively collects overflow coins and retains the same in a convenient manner for subsequent sorting operations.

A further advantage of the present invention is the provision of a coin sorting apparatus which is conveniently loaded with coins and selectively activated in a simultaneous and one-handed manner.

A still further advantage of the present invention is the provision of a coin sorting apparatus which prevents the sorted coins from undesirably bouncing or rolling as they move toward the sorted coin wrappers.

A yet further advantage of the invention is the provision of a coin sorting apparatus in which sorted coins slide toward the sorted coin wrappers on only one axis.

Still other benefits and advantages of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE INVENTION

Figure 1:
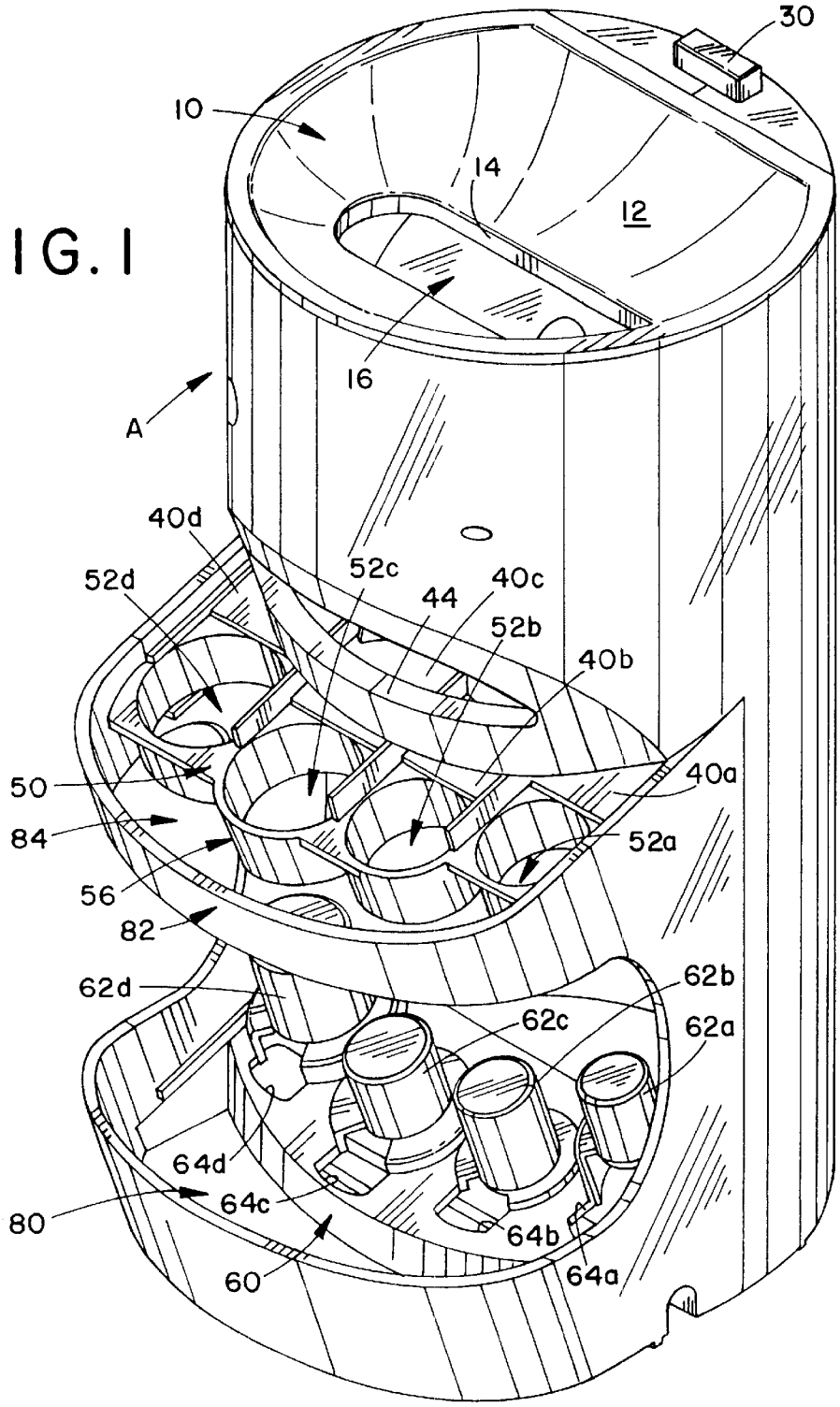
FIG. 1 is a perspective view of a coin sorting apparatus in accordance with the present invention.

With reference now to FIG. 1, a coin sorting apparatus A according to the present invention includes an unsorted coin hopper portion 10 into which a user deposits a plurality of unsorted coins. The hopper portion includes a funnel 12 which directs the unsorted coins from an enlarged mouth to an aperture 14 formed in the funnel portion. Coins that pass through the funnel aperture 14 are communicated to a coin tray 16.

Figure 3:
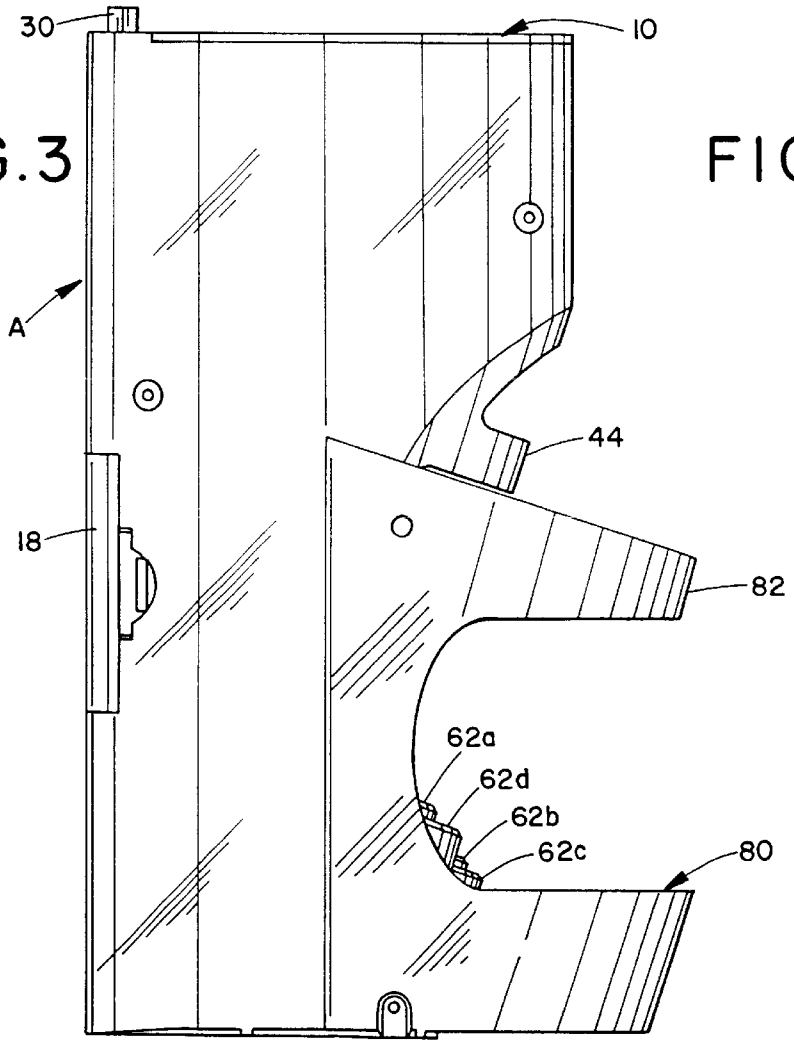
FIGS. 3 and 5 are right and left side elevational views, respectively, of the coin sorting apparatus of FIG. 1.
Figure 4:
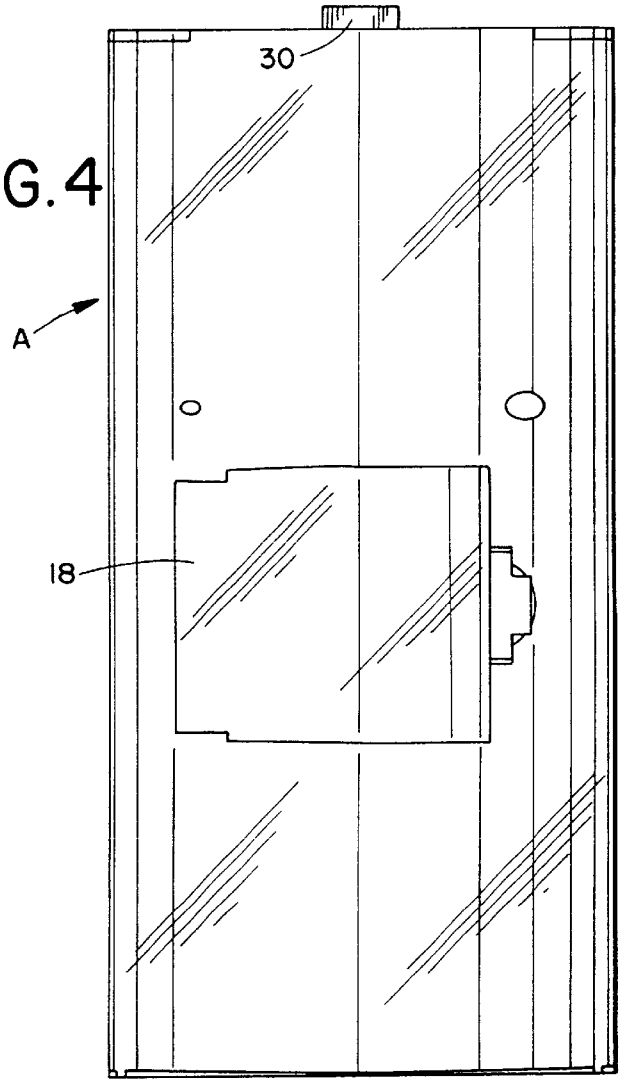
FIG. 4 is a rear elevational view of the coin sorting apparatus of FIG. 1.
Figure 5:
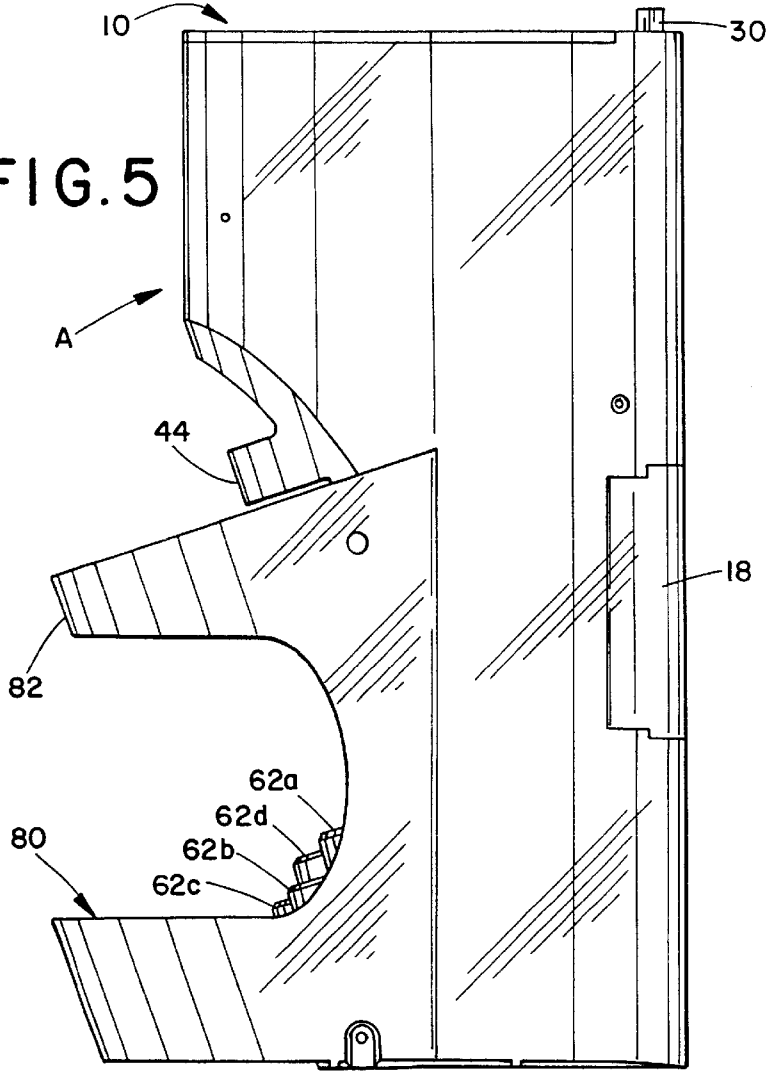
Figure 8:
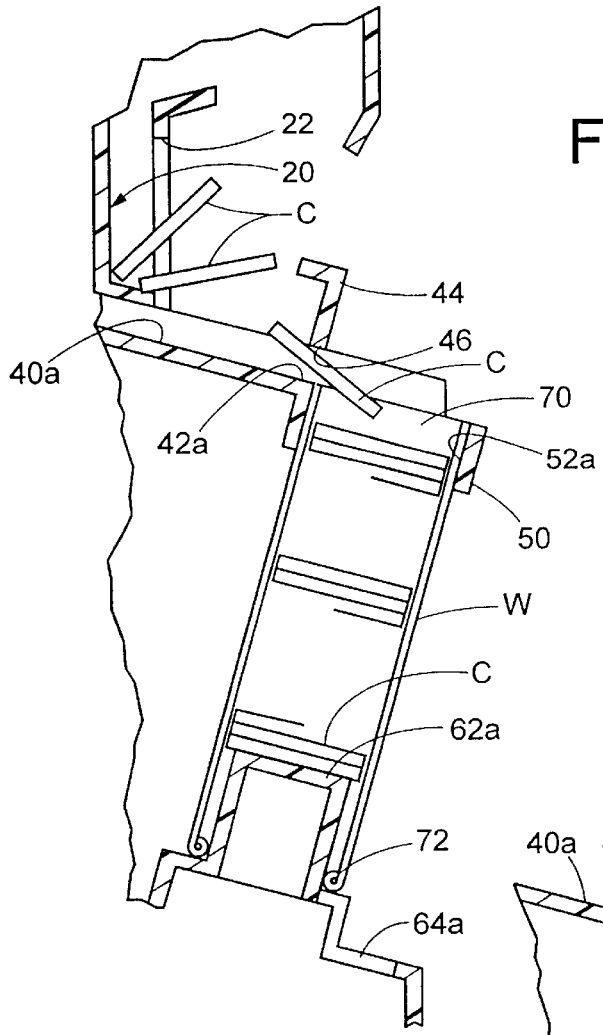
FIG. 8 is a partial side elevational view in cross-section illustrating the sorted coin storage region of the apparatus of FIG. 1 and showing coin movement into a sorted coin wrapper.

The coin tray 16 forms a part of the preferred coin separator mechanism by which the plurality of unsorted coins are individually communicated from the hopper portion 10 to a coin sorting ramp 20 (FIG. 8). In particular, the preferred electro-mechanical coin separating mechanism and helical coin sorting ramp are disclosed in commonly assigned U.S. Pat. No. 5,474,496, the disclosure of which is expressly incorporated by reference herein. While the apparatus disclosed in U.S. Pat. No. 5,474,496 relies upon the use of an automatic switch mechanism for activating the electro-mechanical coin separating mechanism when coins are loaded into the hopper, the coin sorting apparatus A of the present invention preferably utilizes a push-button switch 30. The switch 30 is spring-biased upward into a normally open position. Upon being depressed by a user, the switch 30 closes so that the electro-mechanical coin separating mechanism is energized with electrical potential preferably from one or more batteries housed in a battery enclosure 18 (FIGS. 3–5).

Figure 11:
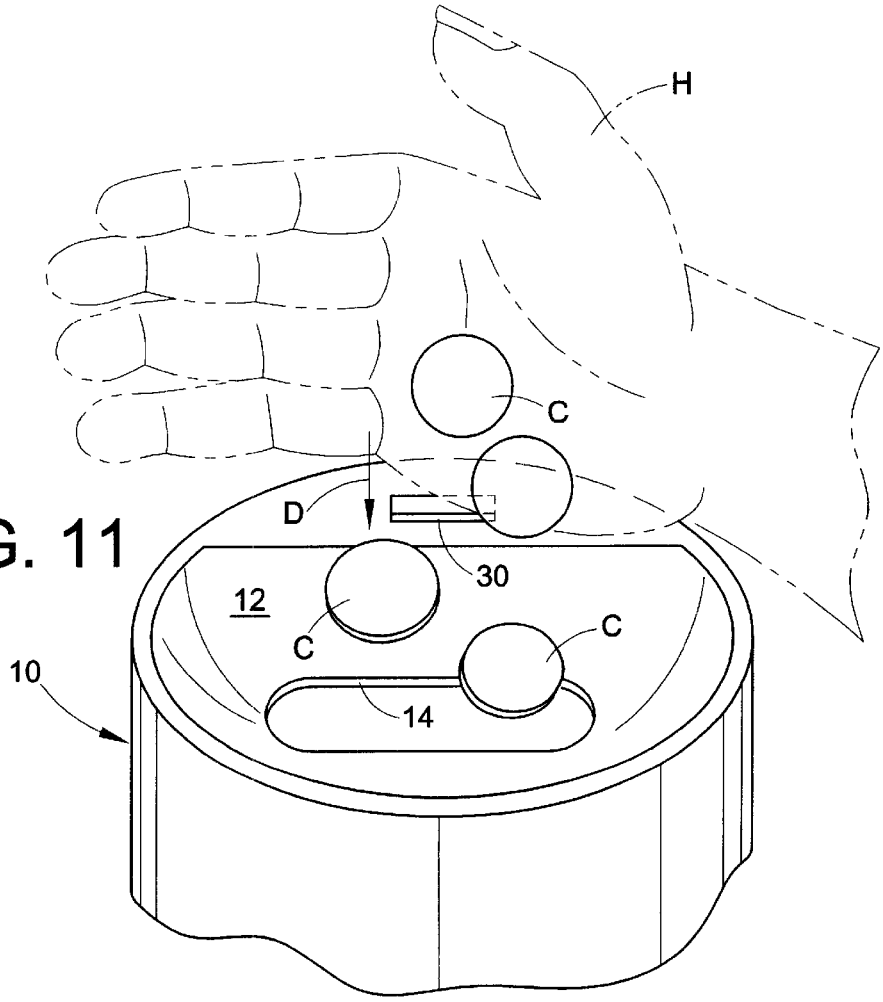
FIG. 11 is a perspective view of an upper coin hopper region of the apparatus of FIG. 1 illustrating simultaneous one-handed coin loading and activation of the coin sorting apparatus; and, FIG. 12 is a perspective view of a helical ramp that includes a plurality of differently sized apertures defined therein as used in the coin sorting apparatus of the present invention.

The switch 30 is preferably located adjacent the enlarged mouth of the coin funnel 12. As shown in FIG. 11, the preferred switch placement allows coins C to be loaded into the hopper portion 10 from a user's hand H and for the simultaneous one-handed depression of the switch 30 by the user's hand H as indicated by the arrow D. In this manner, the electro-mechanical coin separating mechanism is activated as coins C are loaded into the hopper 10. The user simply maintains pressure on the switch 30 with his or her hand H until all coins C are conveyed from the hopper H onto the ramp 20.

Figure 12:
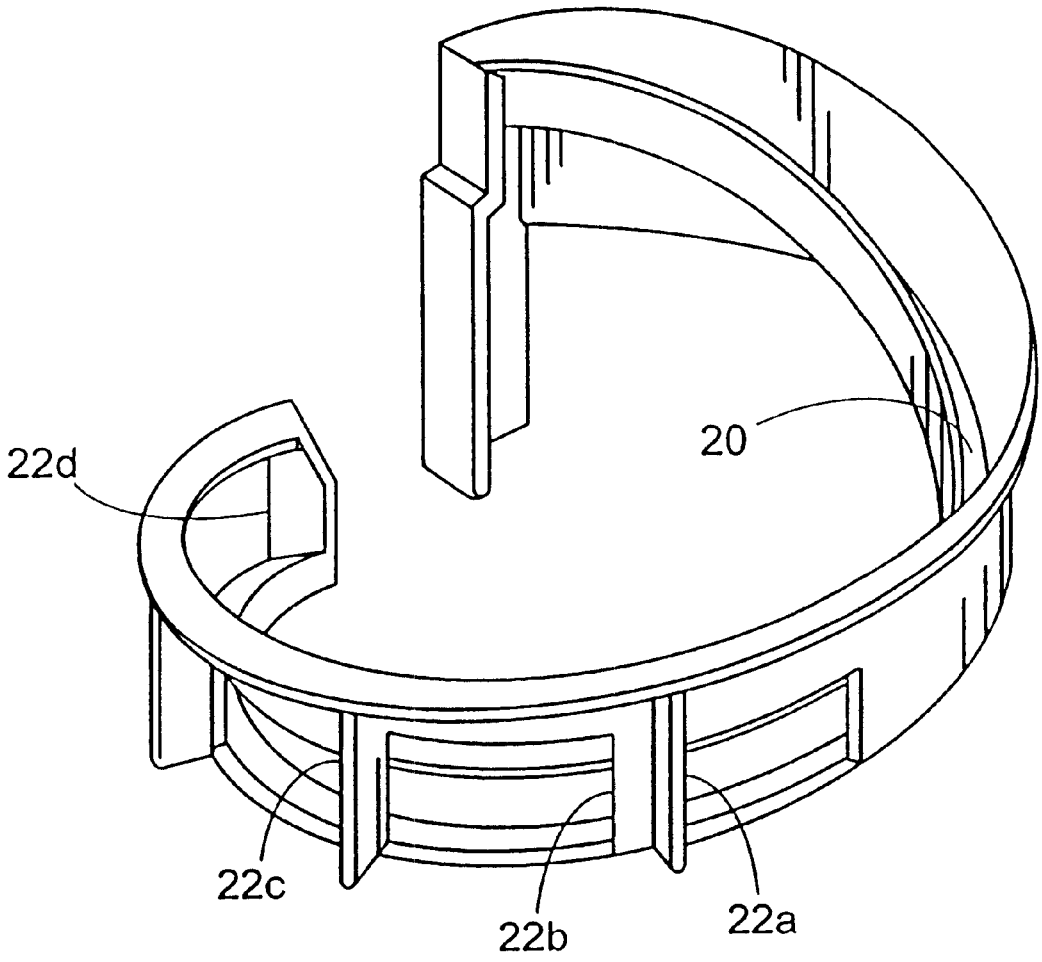
FIG. 12 (PRIOR ART)

As is described in the aforementioned U.S. Pat. No. 5,474,496, coins rolling downward under the force of gravity on the helical ramp 20 (FIGS. 8 and 12) pass through one of a plurality of differently sized apertures as illustrated generally at 22 in FIG. 8 formed in the ramp according to their diameter. In the case of sorting the most common circulating coins of the United States of America, four apertures 22*a–d* (FIG. 12) are formed through the ramp for sorting dimes, pennies, nickels, and quarters. Those skilled in the art will recognize that the apertures 22 are formed slightly larger than the diameter of the coin to pass therethrough and that the apertures are arranged in order of increasing size moving down the ramp. Coins that pass through the four apertures are deposited onto one of four coin chutes 40*a*, 40*b*, 40*c*, 40*d*, respectively, which slope downward toward a coin wrapper collar assembly 50.

With continuing reference to FIG. 1, the coin wrapper collar assembly 50 includes a plurality of coin wrapper receiving apertures 52*a*, 52*b*, 52*c*, 52*d* formed therethrough. An associated coin wrapper support base assembly 60 includes a plurality of coin wrapper support bases 62*a*, 62*b*, 62*c*, 62*d*. The bases 62*a*–62*d* are so sized and located as to cooperate respectively with the collar apertures 52*a*–52*d* to retain conventional pre-rolled cylindrical coin wrappers W, made from paper or the like, in an operative position for receiving sorted coins from the coin chutes 40*a*–40*d*. It will be recognized that the cylindrical wrappers for each coin denomination have a different diameter. Therefore, it is preferable that each collar aperture 52*a*–52*d* have a diameter that corresponds to the outer diameter of the particular wrapper W to be supported therein so that the wrapper is not able to move laterally relative to the collar assembly 50.

Figure 2:
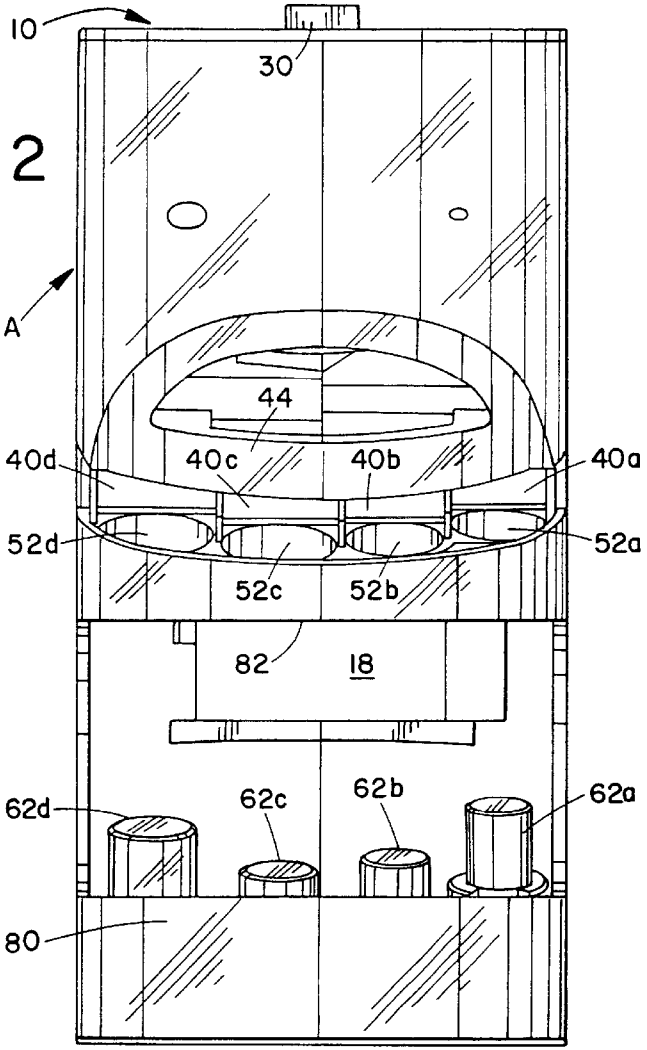
FIG. 2 is a front elevational view of the coin sorting apparatus shown in FIG. 1.

By way of example, it may be seen in FIG. 8 that a coin wrapper W is secured in the operative position with an open upper end 70 supported in the aperture 52*a* of the collar assembly 50 and with a pre-rolled lower end 72 supported by an associated and aligned support base 62*a* such that the support base is received in the pre-formed lower end 72 of the wrapper. Each support base 62*a*–62*d* has a select different height, as can be seen in FIGS. 2, 3, and 5, such that it will extend into the supported wrapper a known distance to control the exact number of coins which are able to be received in the wrapper. In this manner, a user may be certain that, when a wrapper is full of coins, it contains a predetermined number of coins, and consequently a predetermined amount of money. It is also preferred that the diameter of each support base 62*a*–62*d* corresponds with the inner diameter of the pre-rolled lower end 72 of each wrapper to ensure accurate wrapper location and to prevent lateral wrapper movement.

With continuing reference to FIG. 8, the wrapper W is supported by the base 62*a* and the collar assembly 50 so that the open upper end of the wrapper is at the same height, or preferably just slightly lower, than the lowermost end or edge 42*a* of the chute 40*a*. This wrapper placement ensures the unobstructed passage of coins from the chute 40*a* into the open end 70 of the wrapper W. For simplicity and ease of understanding the present invention, FIG. 8 illustrates the operative support of a single wrapper W by the aperture 52*a* of the collar assembly 50 and an associated support base 62*a* of the support base assembly 60. However, those skilled in the art will certainly recognize that each aperture 52*a*–52*d* works together with an associated and aligned one of the support bases 62*a*–62*d*, respectively, to support a respective wrapper W operatively adjacent the chutes 40*a*–40*d* to receive the relevant coins.

Figure 9:
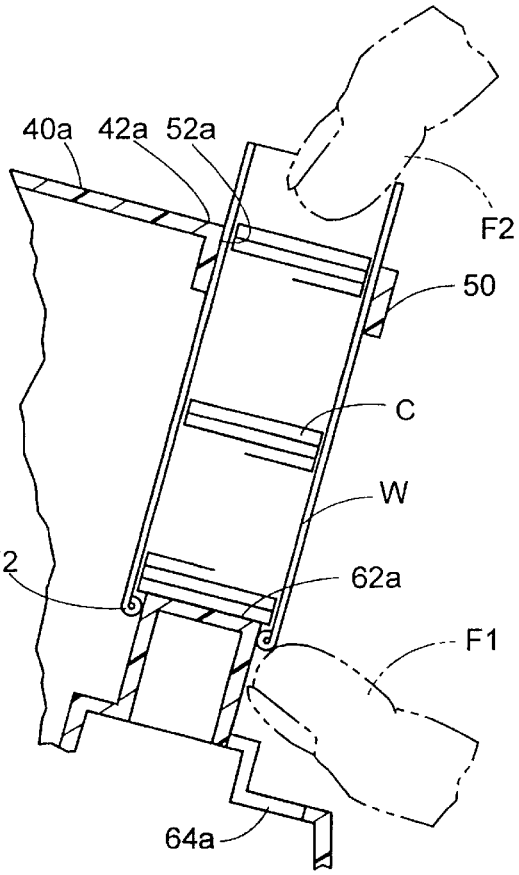
FIG. 9 is a partial side elevational view in cross-section illustrating operator removal of a filled coin storage wrapper from the apparatus of FIG. 1.

FIG. 9 most clearly illustrates the preferred means for user removal of a filled coin wrapper W from its operative position in the apparatus A. As shown in FIG. 1, each wrapper support base 62*a*–62*d* of the wrapper support base assembly 60 respectively includes an associated finger access aperture or recess 64*a*–64*d* formed in the base assembly 60. Each finger access recess 64*a*–64*d* is formed in the assembly 60 adjacent a lower portion of its associated base 62*a*–62*d* so that a user of the apparatus is able to insert a first finger F1 into the recess 64*a*–64*d* and lift the lower end 72 of the supported coin wrapper W. The rolled lower end 72 does not allow coins to exit when the wrapper is lifted. As shown, a user may also use a finger F2 to prevent spillage of coins C from the open wrapper end 70 and to constrict the upper end 70 to seal the wrapper. Without the inclusion of the subject recesses 64*a*–64*d*, removal of filled coin wrappers W would be quite difficult, especially considering the proximity of adjacent wrappers which limits finger access. As the wrapper W is pushed up the base 62*a*, the coins C slide down toward the rolled lower end 72 of the wrapper leaving room at the upper end of the wrapper to allow the upper end to be folded up, thus forming a filled coin wrapper.

To ensure that sorted coins C slide on their front or back faces in the chutes 40*a*–40*d*, rather than roll or bounce, the apparatus A further includes a baffle 44 that spans all of the chutes 40*a*–40*d*. With particular reference to FIG. 8, a coin C on the chute 40*a* is prevented from rolling or bouncing by the baffle 44. Instead, each coin C on the chute 40*a* must pass on either its front or rear face through a slot 46 defined by the baffle 44 and the chute 40*a*. In this manner, coins C are certain to pass into the wrapper W adjacent the chute lower edge 42*a*. Again, those skilled in the art will recognize that the baffle 44 also ensures that coins C do not bounce or roll on the chutes 40*b*–*d* in the same manner as described in relation to the chute 40*a*.

Figure 10:
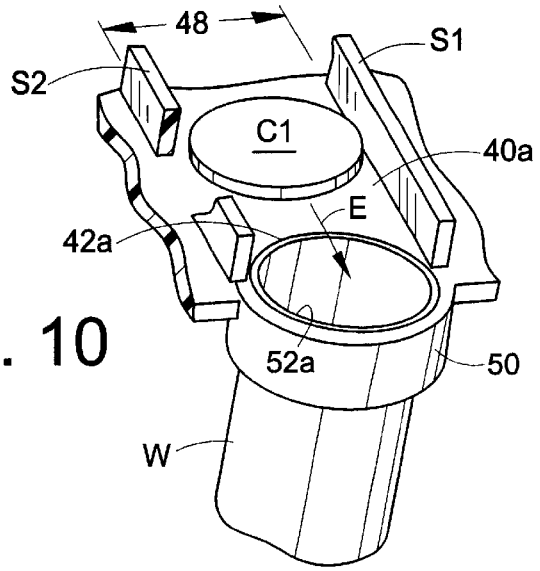
FIG. 10 is an enlarged partial perspective view illustrating a coin chute in accordance with the present invention.

To further control the sliding movement of coins C on the chutes 40*a*–40*d*, each chute has a width which is only slightly or minimally larger than the diameter of the particular coins to be passed thereon. By way of example, and with reference to FIG. 10, the chute 40*a* has a diameter 48 defined by the sidewalls S1–S2 which is only large enough to allow the unobstructed passage of the coin C1 under the force of gravity into the adjacent wrapper W. As such, it may be appreciated that the coin C1 moves toward the wrapper W in a direction E on only a single axis and without appreciable lateral movement in a direction transverse to the direction E. As such, the coin C1 is certain to enter the wrapper W, and do so in a quick and smooth fashion.

When a wrapper W is filled to capacity with coins C, additional coins from one of the chutes 40*a*–40*d* destined for the full wrapper will slide over the top of the filled wrapper and fall into the overflow tray 80. The tray 80 extends forwardly from the coin wrapper base assembly 60 and conveniently retains all overflow coins therein. The tray is open for ease of coin removal therefrom.

Figure 6:
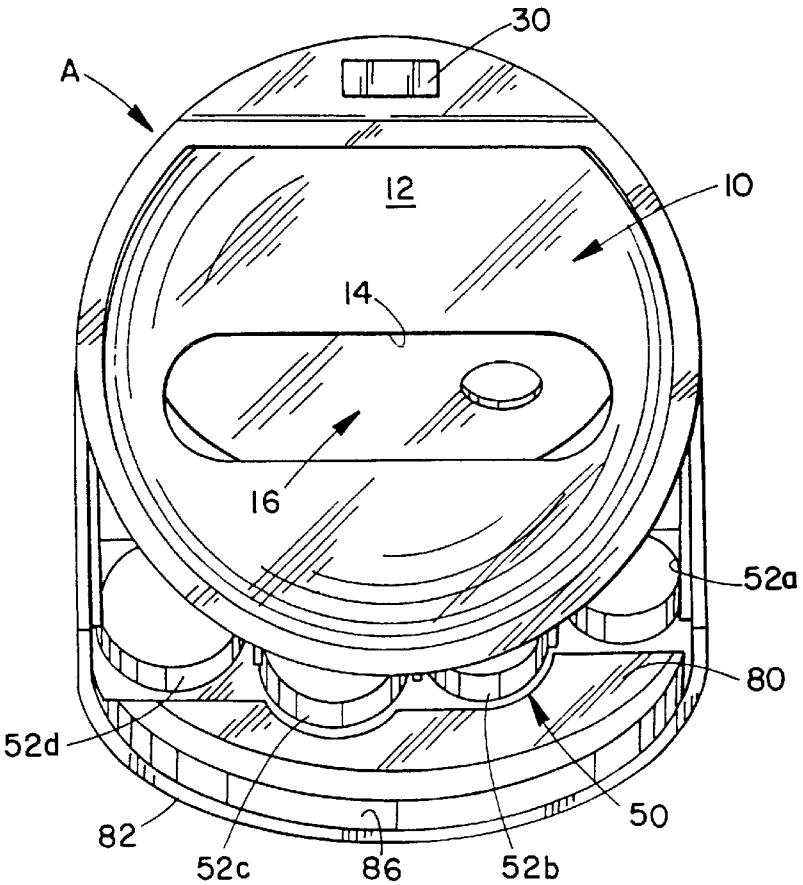
FIGS. 6 and 7 are top and bottom views, respectively, of the coin sorting apparatus of FIG. 1.
Figure 7:
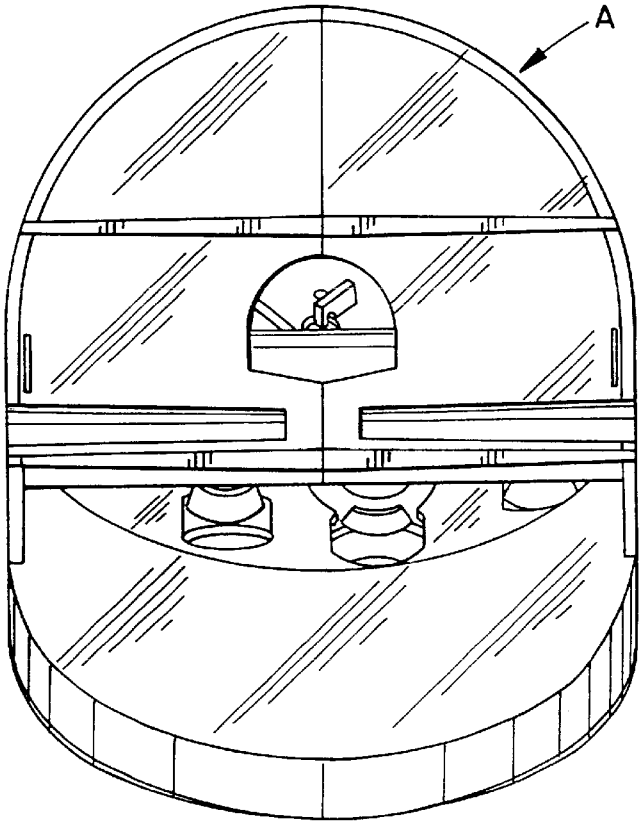

To ensure that overflow coins from the chutes 40*a*–40*d* do not overshoot the tray 80 or bounce out of the tray, an overflow coin deflector 82 is provided. The coin deflector 82 surrounds a forward region 56 of the collar assembly 50 in a spaced relationship therewith. Between the deflector 82 and collar assembly 50, a coin overflow passage 84 is defined. Coins from any chute 40*a*–40*d* sliding over a full wrapper W will either fall directly through the coin overflow passage 84 into the tray 80 below or will strike the angled inner face 86 (FIG. 6) of the deflector 82 and be deflected downward through the passage 84 and into the tray 80. The inner face 86 of the deflector 82 is advantageously angled both downward and inward toward the plurality of coin wrappers W to further counteract the tendency of the overflow coins to bounce out of the tray 80.

The invention has been described with reference to a preferred embodiment. Modifications and alterations will occur to others upon reading and understanding the preceding specification. It is intended that the invention be construed as including all such modifications and alterations insofar as they come within the scope of the appended claims or the equivalents thereof.

Having thus described the preferred embodiments, the invention is now claimed to be:

1. A coin sorting apparatus comprising:

a hopper for receiving a plurality of associated unsorted coins;

a helical coin ramp conformed for supporting the associated coins rolling on edge from an upper end of said ramp toward a lower end of said ramp, said ramp including a plurality of spaced differently sized apertures formed therethrough such that each coin rolling on the ramp passes through one of said differently sized apertures according to its diameter;

a plurality of coin sliding surfaces placed respectively beneath said plurality of differently sized apertures, each of said coin sliding surfaces conformed to support the associated coins for sliding movement on a coin face from a sliding surface upper end toward a sliding surface lower end; and, a collar assembly for releasably securing an open upper end of each of a plurality of associated coin holders adjacent a respective one of said plurality of coin sliding surfaces.

2. A coin sorting apparatus comprising:

a helical coin ramp upon which associated coins roll on edge along a helical path by gravity from an upper region toward a lower region, and from which the associated coins are removed at select locations according to their size;

a coin transitioning surface for contacting the associated coins to transition the associated coins from rolling on edge to sliding on a face; and, a plurality of downwardly sloping coin sliding surfaces each having an upper end and a lower end, said plurality of sliding surfaces respectively positioned to receive, at said upper end, associated coins from the select ramp locations and to transport the received associated coins slidably on a coin face toward said lower end thereof.

3. The coin sorting apparatus as set forth in claim 2, further comprising:

a holder for mounting at least a portion of each of a plurality of associated coin containers and retaining said associated containers respectively adjacent said lower end of said plurality of downwardly sloping sliding surfaces.

4. The coin sorting apparatus as set forth in claim 3, further comprising:

a coin container base assembly including a plurality of pedestal bases spaced from said holder, wherein said associated coin containers are operably supported between said pedestal bases and said holder with said pedestal bases inserted into a lower end of said associated containers, respectively.

5. The coin sorting apparatus as set forth in claim 4, wherein said coin container base assembly defines a plurality of finger-receiving recesses respectively adjacent said pedestal bases.

6. The coin sorting apparatus as set forth in claim 4, wherein said pedestal bases are defined with varying heights to control a maximum number of coins that can be accommodated in said associated coin containers into which said pedestal bases are respectively inserted.

7. The coin sorting apparatus as set forth in claim 2, further comprising:

a hopper for receiving a plurality of unsorted associated coins; and, a coin separator that moves coins from the hopper to said upper region of said helical ramp.

8. The coin sorting apparatus as set forth in claim 7, further comprising:

an electric motor drivingly connected to said coin separator; and, a switch adapted for manual movement between at least a first position, wherein said switch interrupts an associated source of electrical power to said motor, and a second position, wherein said switch electrically connects said associated source of electrical power to said motor.

9. The coin sorting apparatus as set forth in claim 8, wherein said switch is located adjacent said hopper and adapted for movement between said first and second positions by a user's hand when said user deposits unsorted coins from said hand into said hopper.

10. The coin sorting apparatus as set forth in claim 9, wherein said switch is a push-button switch normally biased into said first position.

11. The coin sorting apparatus as set forth in claim 2, wherein said coin transitioning surface is positioned in spaced relation above said plurality of sliding surfaces, said transitioning surface and each of said coin sliding surfaces defining therebetween an opening dimensioned to prevent passage of an associated coin having the smallest diameter when said associated smallest diameter coin is rolling on edge.

12. The coin sorting apparatus as set forth in claim 11, wherein said transitioning surface comprises a unitary wall member that projects upwardly away from said plurality of sliding surfaces.

13. The coin sorting apparatus as set forth in claim 11, wherein said ramp is conformed with a plurality of apertures defined therethrough and located at each of the select locations, said apertures increasing in size moving from said upper region toward said lower region on said helical path.

14. The coin sorting apparatus as set forth in claim 2, further comprising:

an overflow tray having an open top, said tray positioned to receive overflow coins from any of said plurality of downwardly sloping sliding surfaces when said overflow coins pass over a filled one of said associated containers.

15. The coin sorting apparatus as set forth in claim 14, further comprising:

an overflow coin deflector vertically spaced above said overflow tray and positioned to deflect overflow coins downwardly into said tray.

16. The coin sorting apparatus as set forth in claim 14, wherein said holder is conformed to retain said associated plurality of coin containers at an angle relative to vertical so that an upper edge of each of said associated plurality of coin containers slopes downwardly in a direction corresponding to said downwardly sloping coin chutes.

17. The coin sorting apparatus as set forth in claim 2, wherein said ramp is conformed with a plurality of apertures defined therethrough and located at each of the select locations, said apertures increasing in size moving from said upper region toward said lower region on said helical path.

18. A coin sorting apparatus comprising:

a plurality of spaced coin sliding surfaces that slope downwardly at a first angle from an upper region toward a lower region and adapted for slidably supporting associated coins for movement on a coin face from said upper region toward said lower region;

a collar assembly for releasably retaining a plurality of associated coin holders respectively adjacent the lower regions of said plurality of coin sliding surfaces;

a plurality of pedestal bases arranged in spaced relation with said collar assembly, said pedestal bases adapted for insertion into open lower ends of said plurality of associated coin holders, respectively, and each defined at a select, predetermined height to control a number of associated coins accommodated between said pedestal and an upper edge of said collar assembly.

19. The coin sorting apparatus as set forth in claim 18, further comprising:

an open overflow coin receiver for receiving overflow coins that pass over a filled one of said associated coin holders.

20. The coin sorting apparatus as set forth in claim 19, wherein said collar assembly supports an open upper end of each of said plurality of associated coin holders at a second angle relative to horizontal that at least approximates said first angle at which said plurality of coin chutes are sloped.

21. The coin sorting apparatus as set forth in claim 19, further comprising:

an overflow coin deflector vertically spaced above the overflow coin receiver, said deflector positioned so that overflow coins impact thereon and are directed downwardly into said overflow coin receiver.

22. The coin sorting apparatus as set forth in claim 18, further comprising:

a wall member extending adjacent and defining a slot with each of said plurality of spaced coin sliding surfaces, said slots dimensioned to prevent passage of a rolling coin therethrough.

23. The coin sorting apparatus as set forth in claim 18, further comprising:

a coin ramp that receives associated coins upstream relative to said plurality of spaced coin sliding surfaces and that moves said associated coins on edge in a helical path from a ramp upper end toward a ramp lower end, said coin ramp conformed to place said associated coins onto the upper region of one of said plurality of spaced coin sliding surfaces according to a diameter of the associated coins whereby each spaced coin sliding surface receives coins of only a single diameter from said ramp.

24. The coin sorting apparatus as set forth in claim 23, wherein each of said plurality of spaced coin sliding surfaces defines a straight coin path between said upper region and said lower region.

25. The coin sorting apparatus as set forth in claim 23, wherein said coin ramp defines a plurality of apertures therethrough arranged in order of increasing size from an upper end of said ramp toward a lower end of said ramp whereby coins rolling on said ramp along said helical coin path pass through a first accommodating one of said plurality of apertures.

26. A method of sorting an unsorted plurality of coins, said method comprising:

dispensing individual coins of an unsorted plurality of coins sequentially on an upper end of a ramp;

rolling the individual coins on edge from the upper end of the ramp toward a lower end of the ramp;

removing the individual coins from the ramp at one of a plurality of spaced ramp locations according to a diameter of the individual coins;

receiving the individual coins from the plurality of spaced ramp locations onto respective downwardly sloped sliding surfaces;

transitioning the individual coins from rolling on edge to sliding on a coin face; and, sliding the individual coins on the downwardly sloped sliding surfaces.

27. The method as set forth in claim 26, further comprising:

receiving coins from said plurality of sloped sliding surfaces into respective ones of a plurality of coin containers.

28. The method as set forth in claim 27, further comprising:

limiting the number of coins in each of the plurality of coin containers to a predetermined number.

29. The method as set forth in claim 28, further comprising:

collecting coins above said predetermined number in an overflow container.

30. A coin handling device comprising:

a housing;

a coin ramp defining a path having a width less than a diameter of a smallest diameter associated coin being handled;

a plurality of coin sliding surfaces each having an upper portion, positioned to receive respective particular denomination associated coins from said coin ramp, and a lower portion, said coin sliding surfaces defining widths greater than a diameter of the respective particular denomination associated coins; and, a coin transitioning member located adjacent said plurality of coin sliding surfaces intermediate said upper portions and said lower portions, said coin transitioning member positioned to contact respective particular denomination associated coins rolling on edge on said coin sliding surfaces and to transition the associated coins from rolling on edge to sliding on a coin face.

31. The coin handling apparatus as set forth in claim 30, further comprising:

a holder for mounting at least a portion of each of a plurality of associated coin containers and retaining an open portion of said associated containers respectively adjacent said lower portions of said plurality of downwardly sloping sliding surfaces.

32. The coin handling device as set forth in claim 31, further comprising:

a plurality of bases arranged in spaced relation with said holder, said bases adapted for insertion into open lower ends of said plurality of associated coin containers, respectively, each of said bases and said holder defining therebetween a space of a predetermined dimension to control a number of associated coins accommodated in said respective associated coin containers.

33. A coin handling device comprising:

a plurality of coin sliding surfaces each having an upper portion and a lower portion and adapted for slidably transporting a respective associated coin on a face from said upper portion toward said lower portion;

a coin transitioning member located adjacent said plurality of coin sliding surfaces intermediate said upper portion and said lower portion, said coin transitioning member positioned to contact a respective associated coin rolling on edge on said adjacent one of said coin sliding surfaces to move said associated rolling coin onto one of its front and rear faces; and, a coin deflector spaced outwardly from said lower portion of each of said plurality of coin sliding surfaces and adapted to contact and deflect coins that overshoot said lower portion of each of said sliding surfaces and become airborne.

34. The coin handling apparatus as set forth in claim 33, further comprising:

a holder for mounting at least a portion of each of a plurality of associated coin containers and retaining said associated containers respectively adjacent said lower portions of said plurality of downwardly sloping sliding surfaces.

35. The coin handling device as set forth in claim 33, further comprising:

a plurality of bases respectively arranged in spaced relation with said lower portions of said sliding surfaces, each of said bases defining a support surface spaced predeterminedly from said respective sliding surface lower portion to control a number of associated coins accommodated between base and said respective ramp lower portion.

36. A coin handling apparatus comprising:

a plurality of spaced coin sliding surfaces that slope downwardly at a first angle from an upper region toward a lower region and adapted for slidably supporting associated coins for movement on a coin face from said upper region toward said lower region;

a plurality of coin containers supported respectively adjacent said lower region of said sliding surfaces at a second angle generally perpendicular to said first angle; and, a plurality of coin support surfaces located adjacent a lower end said plurality of coin containers and adapted to support a lowermost coin held in said containers, respectively, a predetermined cylindrical volume being defined between each of said coin support surfaces and a location adjacent said lower region of said sliding surfaces whereby only a predetermined select number of associated coins is accommodated in said volume.

* * * * *